US012097592B2

(12) United States Patent
Mejean et al.

(10) Patent No.: US 12,097,592 B2
(45) **Date of Patent: *Sep. 24, 2024**

(54) BONDED ABRASIVE ARTICLE AND METHOD OF MAKING THE SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Cecile O. Mejean, Acton, MA (US); John S. Hagan, Shrewsbury, MA (US); Linda S. Bateman, Spencer, MA (US); Alexandre Temperelli, Boston, MA (US); Taewook Hwang, Acton, MA (US); Ramanujam Vedantham, Shrewsbury, MA (US); John M. Gulcius, Shrewsbury, MA (US); Maureen A. Brosnan, West Boylston, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

This patent is subject to a terminal disclaimer.

(21) Appl. No.: 18/308,101

(22) Filed: Apr. 27, 2023

(65) Prior Publication Data

US 2023/0356360 A1 Nov. 9, 2023

Related U.S. Application Data

(63) Continuation of application No. 17/371,401, filed on Jul. 9, 2021, now Pat. No. 11,667,009.

(Continued)

(51) Int. Cl.
*B24D 3/18* (2006.01)

(52) U.S. Cl.
CPC ..... *B24D 3/18* (2013.01)

(58) Field of Classification Search
CPC ..... B24D 3/04; B24D 3/14; B24D 3/18
See application file for complete search history.

(56) References Cited

U.S. PATENT DOCUMENTS 4,977,710 A 12/1990 Une
6,319,108 B1 * 11/2001 Adefris ..... B24D 3/10 451/526

(Continued)

FOREIGN PATENT DOCUMENTS

CN 101870091 B 9/2011
CN 104582901 A 4/2015

(Continued)

OTHER PUBLICATIONS

International Search Report & Written Opinion dated Nov. 12, 2021, with regard to International Application PCT/US2021/041048.

(Continued)

*Primary Examiner* — Pegah Parvini
(74) *Attorney, Agent, or Firm* — Abel Schillinger, LLP; Arpan Ghosh

(57) ABSTRACT

An abrasive article can include a body including a bond material, abrasive particles, and a plurality of pores, wherein the bond material can comprise a vitreous material. In one embodiment, an average particle size of the abrasive particles can be between 0.1 microns to 5 microns, and a porosity of the body may be between 40 vol % to 70 vol %, wherein the porosity may define an average pore size (D50) of at least 0.1 microns and not greater than 5 microns.

31 Claims, 6 Drawing Sheets

Related U.S. Application Data

(60) Provisional application No. 63/050,620, filed on Jul. 10, 2020.

(56) References Cited

U.S. PATENT DOCUMENTS

| | | | | |
|---|---|---|---|---|
| 6,609,963 | B2 | 8/2003 | Li | |
| 6,755,729 | B2 | 6/2004 | Ramanath | |
| 7,329,175 | B2 | 2/2008 | Woo et al. | |
| 7,544,114 | B2 | 6/2009 | Orlhac | |
| 8,771,390 | B2 | 7/2014 | Upadhyay | |
| 9,982,175 | B2 | 5/2018 | Sarangi | |
| 10,259,102 | B2 | 4/2019 | Goers | |
| 10,518,387 | B2 | 12/2019 | Mao | |
| 11,667,009 | B2 * | 6/2023 | Mejean | B24D 3/18 51/307 |
| 2008/0222967 | A1 | 9/2008 | Querel | |
| 2014/0007517 | A1 | 1/2014 | Sarangi et al. | |
| 2014/0017985 | A1 | 1/2014 | Tian | |
| 2014/0287658 | A1 | 9/2014 | Flaschberger et al. | |
| 2016/0151886 | A1 | 6/2016 | Sarangi | |
| 2018/0085896 | A1 | 3/2018 | Paramban | |
| 2019/0299365 | A1 | 10/2019 | Gasdaska et al. | |
| 2020/0055162 | A1 | 2/2020 | Gasdaska et al. | |

FOREIGN PATENT DOCUMENTS

| | | | |
|---|---|---|---|
| CN | 107206574 | A | 9/2017 |
| EP | 1216774 | B1 | 10/2003 |
| EP | 2455185 | A2 | 5/2012 |
| EP | 2132002 | B1 | 7/2012 |
| EP | 2682232 | A1 | 1/2014 |
| EP | 2782712 | B1 | 7/2020 |
| JP | H06-211542 | A | 8/1994 |
| JP | 2884031 | B2 | 4/1999 |
| JP | 2002-018726 | A | 1/2002 |
| JP | 2002030272 | A | 1/2002 |
| JP | 2003-505262 | A | 2/2003 |
| JP | 2004-249459 | A | 9/2004 |
| JP | 200830194 | A | 2/2008 |
| JP | 2008526529 | A | 7/2008 |
| JP | 4592207 | B2 | 12/2010 |
| JP | 2011-140097 | A | 7/2011 |
| JP | 2012-152881 | A | 8/2012 |
| JP | 2014-061585 | A | 4/2014 |
| JP | 2014-533209 | A | 12/2014 |
| JP | 2017-185575 | A | 10/2017 |
| JP | 2017538588 | A | 12/2017 |
| TW | 201908059 | A | 3/2019 |
| WO | 2004037490 | A1 | 5/2004 |
| WO | 2011056680 | A2 | 5/2011 |
| WO | 2019067761 | A1 | 4/2019 |
| WO | 2022011234 | A1 | 1/2022 |

OTHER PUBLICATIONS

The Ceramic Society of Japan "Ceramic Engineering Handbook" 1st edition, Published on Apr. 10, 1989, 7 pages.

* cited by examiner

BONDED ABRASIVE ARTICLE AND METHOD OF MAKING THE SAME

CROSS REFERENCE TO RELATED APPLICATION(S)

This application is a continuation application of and claims priority under 35 U.S.C. § 120 to U.S. patent application Ser. No. 17/371,401, entitled "BONDED ABRASIVE ARTICLE AND METHOD OF MAKING THE SAME," by Cecile O. MEJEAN et al., filed Jul. 9, 2021, which claims priority under 35 U.S.C. § 119(e) to U.S. Provisional Application No. 63/050,620, entitled "BONDED ABRASIVE ARTICLE AND METHOD OF MAKING THE SAME," by Cecile O. MEJEAN et al., filed Jul. 10, 2020, all of which are assigned to the current assignees hereof and incorporated by reference in their entireties for all purposes.

BACKGROUND

Field of the Disclosure

The following is directed to an abrasive article, and particularly, to an abrasive article including a vitreous bond material, abrasive particles including a superabrasive material, and a plurality of pores, and a method of making the bonded abrasive article.

Description of the Related Art

Bonded abrasive articles, such as abrasive wheels, can be used for cutting, grinding, or shaping various materials. The industry continues to demand improved bonded abrasive articles with high grinding precision, high efficiency and extended lifetime.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
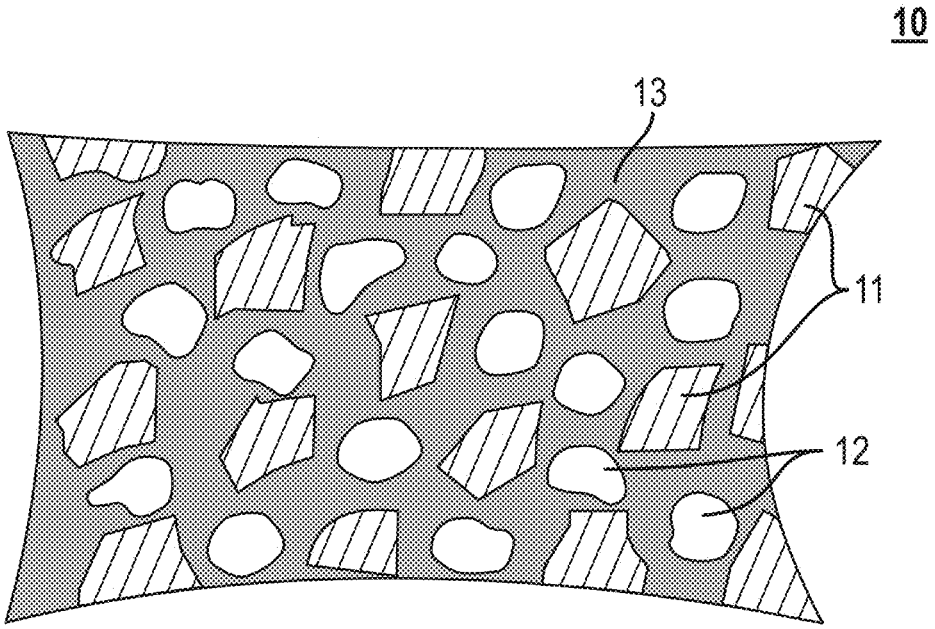
FIG. 1 includes an illustration of a cross section of a body of an abrasive article according to an embodiment.

The following description in combination with the figures is provided to assist in understanding the teachings provided herein. The following disclosure will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

Embodiments disclosed herein are directed to an abrasive article comprising a body, wherein the body can include a bond material comprising a vitreous material, abrasive particles contained in the bond material, and a plurality of pores. In one aspect, the body can comprise at least one of the following: a porosity of at least 40 vol % and not greater than 70 vol % for a total volume of the body; a content of abrasive particles of at least 10 wt % and not greater than 95 wt % for a total weight of the body; an average particle size (D50) of the abrasive particles of at least 0.05 microns and not greater than 5 microns; an average pore size (D50) of the plurality of pores being at least 0.1 microns and not greater than 5 microns; or any combination thereof. In a particular aspect, the abrasive article may be suitable for high precision grinding.

In one embodiment, a method of forming the body of the abrasive article of the present disclosure can comprise: providing a powder mixture including abrasive particles and a bond material, the bond material including a vitreous material; filling the powder mixture into a mold; applying pressure on the powder mixture in the mold, and heating the pressed powder mixture to a temperature of at least 600° C.

In certain aspects, the powder mixture can be made by making an aqueous dispersion of the abrasive particles and the bond material and conducting spray drying, freeze casting, or freeze drying, or conducting high shear mixing of the dry or wet ingredients, grinding, milling, sieving, filtering, or any combination thereof.

In one aspect, the powder mixture can have a water content of not greater than 5 wt % based on the total weight of the powder mixture, or not greater than 4 wt %, or not greater than 3 wt %, or not greater than 2 wt %.

In a particular aspect, the powder mixture can have an average particle size (D50) of at least 0.5 microns, or at least 0.6 microns, or at least 0.8 microns, or at least 1 micron. In another aspect, the D50 value may be not greater than 2 microns, or not greater than 1.5 micron, or not greater than 1.0 micron.

In one aspect, filling the powder mixture into the mold can include sequential filling of the mold combined with agitation of the powder to form a pre-compacted powder mixture to reach the tap density of the powder mixture. As used herein, the tap density of the powder mixtures is determined according to ASTM D7481.

In one aspect, the tap density of the pre-compacted powder mixture in the mold can be at least 0.45 g/cm$^3$, or at least 0.50 g/cm$^3$, or at least 0.52 g/cm$^3$, or at least 0.54 g/cm$^3$.

After the filling of the mold, the mold can be closed and a pressure may be applied to press the powder mixture contained in the mold to a pre-determined volume, herein also called "pressing to volume."

In one embodiment, the pressing can be conducted by cold pressing. As used herein, the term "cold pressing" means conducting pressing at room temperature or slightly elevated temperature. In one aspect, cold-pressing can be conducted at a temperature of at least 20° C., or at least 25° C. or at least 30° C. or at least 50° C., and not greater than 80° C., or not greater than 60° C., or not greater than 40° C.

In certain aspects, the applied pressure during cold pressing can be at least 40 MPa, or at least 60 MPa, or at least 100 MPa, or at least 120 MPa. In another aspect, the applied pressure may be not greater than 150 MPa, or not greater than 130 MPa, or not greater than 125 MPa.

In a further aspect, after cold-pressing the cold-pressed body can be removed from the mold before conducting the heating. In a certain aspect, heating of the cold-pressed body can be conducted at a maximum heating temperature of at least 620° C., or at least 650° C., or at least 680° C., or at least 700° C. In another certain aspect, the maximum heating temperature may be not greater than 850° C., or not greater than 800° C., or not greater than 750° C.

As illustrated in FIG. 1, the body (10) can comprise abrasive particles (11) and a plurality of fine pores (12) evenly distributed within the bond material (13).

In one aspect, the abrasive particles can comprise a superabrasive material, for example, diamond, cubic boron nitride, or a combination thereof. In a particular aspect, the superabrasive material can include diamond. In a certain particular aspect, the superabrasive material can consist essentially of diamond.

In one embodiment the average particle size (D50) of the abrasive particles can be at least 0.1 microns, or at least at least 0.3 microns, or at least 0.4 microns, or at least 0.5 microns, or at least 0.8 microns, or at least 1 micron, or at least 1.5 microns, or at least 2 microns, or at least 3 microns. In another embodiment, the average particle size (D50), may be not greater than 5 microns or not greater than 4 microns, or not greater than 3 microns, or not greater than 2.5 microns, or not greater than 2.0 microns, or not greater than 1.5 microns, or not greater than 1.3 microns, or not greater than 1.0 micron, or not greater than 0.9 microns, or not greater than 0.8 microns, or not greater than 0.7 microns, or not greater than 0.6 microns. The average particle size (D50) of the abrasive particles may be a value between any of the minimum and maximum values noted above. In a particular aspect, the average particle size (D50) of the abrasive particles may be at least 0.3 microns and not greater than 0.7 microns.

In a further embodiment, an amount of the abrasive particles can be at least 15 wt % based on the total weight of the body, such as at least 20 wt %, or at least 25 wt %, or at least 30 wt %, or at least 35 wt %, or at least 40 wt %, or at least 45 wt %, or at least 50 wt %, or at least 55 wt %, or at least 60 wt %. In another aspect, the amount of abrasive particles may be not greater than 95 wt % based on the total weight of the body or not greater than 93 wt %, or not greater than 90 wt %, or not greater than 85 wt %, or not greater than 80 wt %, or not greater than 75 wt %, or not greater than 70 wt %, or not greater than 65 wt %, or not greater than 60 wt %, or not greater than 55 wt %, or not greater than 50 wt %. The amount of abrasive particles can be a value between any of the minimum and maximum values noted above.

In yet a further aspect, the amount of the abrasive particles may be at least 30 vol % based on the total volume of the body, such as at least 35 vol %, at least 40 vol %, at least 45 vol %, or at least 50 vol %. In another aspect, the amount of abrasive particles may be not greater than 65 vol %, or not greater than 60 vol %, or not greater than 55 vol %, or not greater than 50 vol %, or not greater than 45 vol %.

In a further embodiment, the porosity of the body can be at least 40 vol % based on the total volume of the body, or at least 41 vol %, or at least 42 vol %, or at least 43 vol %, or at least 44 vol %, or at least 45 vol %, or at least 46 vol %, or at least 47 vol %, or at least 48 vol %, or at least 49 vol %, or at least 50 vol %. In another embodiment, the porosity of the body may be not greater than 70 vol %, or not greater than 65 vol %, or not greater than 60 vol %, or not greater than 58 vol %, or not greater than 56 vol %, or not greater than 55 vol %, or not greater than 54 vol %, or not greater than 53 vol %, or not greater than 52 vol %, or not greater than 51 vol %, or not greater than 50 vol %. The porosity of the body can be a value between any of the minimum and maximum values noted above. In a particular aspect, the porosity can be at least 52 vol % to not greater than 60 vol % based on the total volume of the body. As used herein, the term "porosity" (unless indicated otherwise) relates to the sum of pores having a pore size of at least 3 nm and being determined by the Archimedes method, called herein also "open porosity."

In a certain embodiment, a ratio of the total porosity Pt (sum of open and closed porosity) to the open porosity Po of the body [$P_t$:$P_o$] may be not greater than 1.25, such as not greater than 1.11 or not greater than 1.05 or not greater than 1.01. Closed porosity is defined as the sum of the pores smaller than 3 nm or of larger discrete isolated pores contained entirely within the body which cannot be detected by the Archimedes method used for the porosity testing.

In one embodiment, the average pore size (D50) of the body can be at least 0.1 microns, or at least 0.2 microns, or at least 0.3 microns, or at least 0.5 microns, or at least 0.8 microns, or at least 1 micron, or at least 5 microns, or at least 10 microns, or at least 15 microns, or at least 20 microns, or at least 30 microns. In yet another embodiment, the average pore size may be not greater than 50 microns, or not greater than 45 microns, or not greater than 40 microns, or not greater than 30 microns, or not greater than 20 microns, or not greater than 10 microns, or not greater than 5 microns, or not greater than 2 microns, or not greater than 1.5 microns, or not greater than 1.0 micron. The average pore size (D50) can be a value between any of the minimum and maximum values noted above, such as at least 0.1 microns and not greater than 50 microns, at least 0.2 microns and not greater than 5 microns, or at least 0.3 microns and not greater than 0.9 microns.

In a further embodiment, the $10^{th}$ percentile (D10) value of the pore size of the body can be at least 0.05 microns, or at least 0.1 microns, such as at least 0.2 microns, or at least 0.3 microns, or at least 0.5 microns, or at least 0.8 microns, or at least 1 micron, or at least 3 microns. In another aspect, the D10 size can be not greater than 10 microns, or not greater than 5 microns or not greater than 1 micron, or not greater than 0.8 microns, or not greater than 0.5 microns. The D10 pore size can be a value between any of the minimum and maximum values noted above, such as from 0.1 microns to 4 microns, or from 0.1 microns to 1 micron, or from 0.2 microns to 0.7 microns.

In yet a further embodiment, the $90^{th}$ percentile value (D90) of the pore size can be at least 0.5 microns, or at least 0.7 microns, or at least 1 micron, or at least 3 microns, or at least 5 microns, or at least 10 microns, or at least 20 microns, or at least 40 microns. In another aspect, the D90 value may be not greater than 70 microns, or not greater than 50 microns, or not greater than 30 microns, or not greater than 10 microns, or not greater than 5 microns, or not greater than 1 micron, or not greater than 0.9 microns, or not greater than 0.8 microns. The D90 pore size can be a value between any of the minimum and maximum values noted above, such as from 0.5 microns to 60 microns, or from 0.5 microns to 5 microns, or from 0.6 microns to microns to 0.95 microns.

In a particular aspect, the $99^{th}$ percentile (D99) value of the pore size of the body can be not greater than 80 microns, such as not greater than 50 microns, or not greater than 10 microns, or not greater than 3 microns, or not greater than 1 micron, or not greater than 0.98 microns.

In another embodiment, the body can have a pore size distribution, wherein the distance between the $10^{th}$ percentile value (D10) of the pore size and the average pore size (D50), i.e., D10-D50, may be not greater than 1 micron, or not greater than 0.5 microns, or not greater than 0.3 microns.

In yet another embodiment, the body can have a pore size distribution, wherein the distance between the average pore size (D50) and the $90^{th}$ percentile value (D90), i.e., D50-D90, can be not greater than 1 micron, or not greater than 0.5 microns, or not greater than 0.4 microns.

In yet a further aspect, the pores can have a multi-modal size distribution, for example, a bimodal or a trimodal size distribution.

In a further particular aspect, at least 95% of the plurality of pores of the body can have a pore size between 0.1 microns to 1 micron, such as at least 96%, or at least 97%, or at least 98%, or at least 99%, or at least 99.5%, or at least 99.9%.

The bond material of the body of the abrasive article may have a particular bond chemistry that may facilitate improved manufacturing and performance of the abrasive article of the present disclosure. In one embodiment, the bond material of the body can comprise a vitreous material. In a particular embodiment, the bond material may consist essentially of a vitreous material. As used herein, consisting essentially of a vitreous material means that at least 99 vol % of the bond material is a vitreous material. The vitreous material can form a vitreous phase during melting and may thereby bind the abrasive particles together. Typical materials for forming a vitreous phase can include natural and synthetic minerals, metal oxides, and non-metal oxides. Non-limiting examples of vitreous material can be glass materials including $SiO_2$ as a majority oxide compound and two or more further oxides, for example, $Al_2O_3$, $Li_2O$, $Na_2O$, $B_2O_3$, $K_2O$, BaO, or any combination thereof. In another embodiment, the bond material may not be limited to a vitreous material and may further contain one or more other inorganic materials, for example, a ceramic, a cermet, a metal, a metal alloy, or any combination thereof. Furthermore, the inorganic material can be an amorphous material, a polycrystalline material, a monocrystalline material or any combination thereof.

In one aspect, the bond material can comprise in addition to the inorganic bond material an organic bond material, hereinafter also called organic binder. During heat treatment, the organic bond material may decompose and can create or assist in forming a desired porosity in the sintered body. The organic bond material can be a natural material, a synthetic material, a resin, an epoxy, a thermoset, a thermoplastic, an elastomer, or any combination thereof. In a certain embodiment, the organic binder can include a polyether, a phenolic resin, an epoxy resin, a polyester resin, a polyurethane, a polyester, a polyimide, a polybenzimidazole, an aromatic polyamide, a modified phenolic resin (such as: epoxy modified and rubber modified resin, or phenolic resin blended with plasticizers), cornstarch, or any combination thereof. In a certain aspect, the organic binder can be polyethylene glycol (PEG). In a particular aspect, the PEG can have a molecular weight of not greater than 18,000 or not greater than 15,000, or not greater than 10,000, or not greater than 8,000. In another particular aspect, the molecular weight of the PEG can be at least 1000, or at least 3000, or at least 5000, or at least 7000.

In one embodiment, an amount of the bond material in the abrasive body after heating (sintering) the pressed body can be at least 5 wt % based on the total weight of the body or at least 7 wt %, or at least 10 wt %, or at least 15 wt %, or at least 20 wt %, or at least 25 wt %, or at least 30 wt %. In another embodiment, an amount of the bond material in the body may be not greater than 90 wt % based on the total weight of the body, or not greater than 80 wt %, or not greater than 70 wt %, or not greater than 60 wt %, or not greater than 50 wt %, or not greater than 40 wt %, or not greater than 30 wt %, or not greater than 20 wt %, or not greater than 15 wt %, or not greater than 10 wt %, or not greater than 8 wt %. The amount of the bond material may be any value of the minimum and maximum values noted above. In a certain aspect, the bond material in a body can consist essentially of the vitreous bond material. Consisting essentially of the vitreous bond material means herein that the bond material contains not more than 1 wt % based on the total weight of the bond material a material which is not a vitreous material. In a certain particular aspect, the bond material can be a vitreous bond material in an amount of at least 5 wt % and not greater than 10 wt % based on the total weight of the body.

In one embodiment, a weight percent ratio $[C_b:C_a]$ of the bond material $[C_b]$ to the abrasive particles $[C_a]$ can range from 1:15 to 10:1 In a particular aspect, the weight percent ratio $[C_b:C_a]$ can range from 1:15 to 1:4, or from 1:15 to 1:10.

The body of the abrasive article of the present disclosure can have a density of at least 1.3 g/cm$^3$, such as at least 1.35 g/cm$^3$, or at least 1.40 g/cm$^3$, or at least 1.42 g/cm$^3$, or at least 1.46 g/cm$^3$, or at least 1.48 g/cm$^3$. In another embodiment, the density of the body may be not greater than 1.6 g/cm$^3$, or not greater than 1.55 g/cm$^3$, or not greater than 1.50 g/cm$^3$, or not greater than 1.45 g/cm$^3$. The density of the body can be a value between any of the minimum and maximum values noted above.

The body of the abrasive article of the present disclosure can have an excellent homogeneous microstructure. In one aspect, the body can have a normalized defect amount (nDFA) of not greater than 5, or not greater than 3, or not greater than 1, the nDFA being a total amount of particle agglomerates per $mm^2$ having a diameter size of 50 microns or greater. In a particular aspect, the body can be free of defects having a diameter size of 50 microns or greater. As used herein, the term "defect" relates to unwanted particle agglomerates of high density within the body and can be identified and counted in an SEM image or optical microscope image taken from a cross-cut surface of the body. The term defect is also interchangeably used herein with the term "agglomerate," if not indicated otherwise.

In another certain particular aspect, a defect within the body can be a particle agglomerate having a diameter of 18 microns or greater, and the body can have a normalized defect amount (nDFA) per $mm^2$ of not greater than 5, or not greater than 3, or not greater than 1. In a certain aspect, the body can be free of defects having a diameter size of 18 microns or greater. In another embodiment, a material of the body of the abrasive article of the present disclosure can have a Shore D hardness according to ASTM D2240 of at least 70, or at least 73, or at least 75, or at least 77.

In a further aspect, the material of the body may have an elastic modulus (EMOD) according to ASTM E1876 of at least 10 GPa, or at least 11 GPa, or at least 12 GPa, or at least 13 GPa, or at least 14 GPa.

It will be appreciated that the body may have any suitable size and shape as known in the art and can be incorporated into various types of abrasive articles to form a bonded abrasive article. For example, the body can be attached to a substrate, such as a hub of a wheel to facilitate formation of a bonded abrasive grinding wheel.

In one embodiment, the body of the abrasive article of the present disclosure can comprise a plurality of bodies, herein also called body segments, and the body segments may be attached to a substrate.

In a certain embodiment, an abrasive article can comprise a substrate and a plurality of bodies attached to the substrate, wherein each body of the plurality of bodies may comprise superabrasive particles contained in a bond material including a vitreous material and a plurality of pores. In a particular aspect, the plurality of bodies attached to the substrate can comprise a Porosity Content Variation (PCV) value of not greater than 1.3. As used herein, the PCV value is the standard deviation of the porosities of all bodies of the plurality of bodies attached to the substrate, wherein at least a plurality of 8 bodies was tested and the combined volume of the tested plurality of bodies is at least 0.45 $cm^3$. In a certain aspect, the PCV value may be not greater than 1.2, or not greater than 1.0, or not greater than 0.8, or not greater than 0.6, or not greater than 0.4, or not greater than 0.3. In a particular embodiment, the amount of the plurality of bodies (herein also called segments) attached to the support of the abrasive article can be at least 40 bodies, or at least 45 bodies, or at least 48 bodies, or at least 50 bodies, or at least 100 bodies, or at least 150 bodies, or at least 200 bodies. In another aspect, the amount of plurality of bodies may be not greater than 500 bodies, or not greater than 300 bodies, or not greater than 100 bodies, or not greater than 70 bodies, or not greater than 50 bodies. The amount of the plurality of bodies of the abrasive article can be a number between any of the minimum and maximum number noted above.

In one aspect, a material of the substrate can include aluminum or steel. In another aspect, the plurality of bodies may be attached to the substrate by an adhesive, for example, an epoxy-adhesive.

In a further embodiment, a batch of bodies can comprise a plurality of bodies, wherein each body of the plurality of bodies may comprise superabrasive particles contained in a bond material including a vitreous material; has a plurality of pores; and may have a total volume of at least 0.20 $cm^3$, wherein the Porosity Content Variation (PCV) value of the plurality of bodies may be not greater than 1.3. In a certain aspect, the total volume of each body can be at least 0.25 $cm^3$, or at least 0.3 $cm^3$, or at least 0.5 $cm^3$, or at least 0.7 $cm^3$, or at least 1 $cm^3$, or at least 5 $cm^3$, or at least 10 $cm^3$, or at least 12 $cm^3$. In another aspect, the total volume of each body may be not greater than 20 $cm^3$, or not greater than 15 $cm^3$, or not greater than 10 $cm^3$, or not greater than 5 $cm^3$, or not greater than 1 $cm^3$, or not greater than 0.5 $cm^3$, or not greater than 0.3 $cm^3$. The PCV value may be a number between any of the minimum and maximum values noted above.

In another embodiment, the present disclosure is directed to a plurality of abrasive articles, wherein each abrasive article of the plurality of articles can comprise a substrate and a plurality of bodies attached to the substrate as described above, and a Porosity Content Variation (PCV) of all bodies of the plurality of abrasive articles may be not greater than 1.3. In a certain aspect, the plurality of abrasive articles can be at least 3 abrasive articles, or at least 5 abrasive articles, or at least 10 abrasive articles, or at least 20, or at least 30, or at least 50, wherein each abrasive article can comprise at least 45 bodies attached to the substrate.

The abrasive article can be configured to conduct a material removal operation on a wafer comprising silicon or a ceramic material selected from the group consisting of oxides, carbides, nitrides, borides, or any combination thereof.

In one particular aspect, a material removal operation on a silicon carbide wafer or silicon carbide ingot can be conducted using the abrasive article to obtain an average surface roughness Ra of not greater than 50 Å, such as not greater than 40 Å, not greater than 30 Å, not greater than 25 Å, not greater than 20 Å, or not greater than 15 Å, or not greater than 10 Å.

In a certain aspect, the abrasive article can be a fixed abrasive vertical spindle (FAVS), suitable for precision grinding under low force and with a low sub-surface damage. In one embodiment, the abrasive article can be adapted to remove material from a silicon carbide wafer having a diameter of at least 200 mm with a total thickness variation of not greater than 2 microns, while the grinding performance may a have G ratio of not greater than 1.0 at a force of 25 lbs.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1. An abrasive article comprising: a body including a bond material, abrasive particles, and a plurality of pores, wherein the bond material comprises a vitreous material; and the abrasive particles are contained in the bond material and comprise a superabrasive material; and wherein the body comprises at least one of: a porosity of at least 40 vol % and not greater than 70 vol % for a total volume of the body; a content of abrasive particles of at least 10 wt % and not greater than 94 wt % for a total weight of the body; an average particle size (D50) of the abrasive particles of at least 0.05 microns and not greater than 5 microns; an average pore size (D50) of the plurality of pores being at least 0.1 microns and not greater than 5 microns; or any combination thereof.

Embodiment 2. An abrasive article comprising: a body including a bond material, abrasive particles, and a plurality of pores, wherein the bond material comprises a vitreous material, and further wherein the abrasive particles are contained in the bond material and comprise a superabrasive material, the abrasive particles further comprising an average particle size (D50) of at least 0.1 microns and not greater than 5 microns, and wherein the body comprises an amount of the abrasive particles of at least 15 wt % for a total weight of the body.

Embodiment 3. An abrasive article comprising: a body including a bond material, abrasive particles and a plurality of pores, wherein the bond material comprises a vitreous material; the abrasive particles are contained in the bond material and comprise a superabrasive material; the abrasive particles have an average particles size (D50) of at least 0.1 microns and not greater than 5 microns; a porosity of the body is at least 40 vol % and not greater than 70 vol % for a total volume of the body; and wherein the porosity defines an average pore size of at least 0.1 microns and not greater than 5 microns.

Embodiment 4. An abrasive article comprising: a substrate; and a plurality of bodies attached to the substrate, wherein each body of the plurality of bodies comprises abrasive particles contained in a bond material including a vitreous material; and the plurality of bodies comprises a plurality of pores, and a normalized Porosity Content Variation (PCV) value of the plurality of bodies is not greater than 1.3.

Embodiment 5. A batch of bodies comprising: a plurality of bodies, wherein each body of the plurality of bodies comprises abrasive particles contained in a bond material including a vitreous material and a plurality of pores; the plurality of bodies has a combined volume of at least 0.45 $cm^3$; and a Porosity Content Variation (PCV) value of the plurality of bodies is not greater than 1.3.

Embodiment 6. The plurality of bodies of Embodiments 4 or 5, wherein the plurality of bodies includes at least 15 bodies, or at least 30 bodies, or at least 40 bodies, or at least 45 bodies, or at least 50 bodies, or at least 100 bodies, or at least 150 bodies, or at least 200 bodies.

Embodiment 7. The plurality of bodies of any one of Embodiments 4-6, wherein the PCV value of the plurality of bodies is not greater than 1.2, or not greater than 1.0, or not greater than 0.8, or not greater than 0.6, or not greater than 0.4, or not greater than 0.3, or not greater than 0.2.

Embodiment 8. The plurality of bodies of any one of Embodiments 4-7, wherein a total volume of each body of the plurality of bodies is at least 0.03 $cm^3$, or at least 0.05 $cm^3$, or at least 0.1 $cm^3$, or at least 0.2 $cm^3$, or at least 0.25 $cm^3$, or at least 0.3 $cm^3$, or at least 0.5 $cm^3$, or at least 0.7 $cm^3$, or at least 1 $cm^3$, or at least 5 $cm^3$, or at least 10 $cm^3$, or at least 12 $cm^3$.

Embodiment 9. The plurality of bodies of any one of Embodiments 4-7, wherein a total volume of each body of the plurality of bodies is not greater than 20 $cm^3$, or not greater than 15 $cm^3$, or not greater than 10 $cm^3$, or not greater than 5 $cm^3$, or not greater than 1 $cm^3$, or not greater than 0.5 $cm^3$, or not greater than 0.3 $cm^3$.

Embodiment 10. A plurality of abrasive articles, wherein each abrasive article of the plurality of abrasive articles comprises the plurality bodies of any one of Embodiments 4 to 9.

Embodiment 11. The plurality of abrasive articles of Embodiment 10, wherein an amount of the plurality of abrasive articles is at least 5 abrasive articles, or at least 10 abrasive articles, or at least 20 abrasive articles, or at least 30 abrasive articles, or at least 50 abrasive articles.

Embodiment 12. The plurality of abrasive articles of Embodiments 10 or 11, wherein a Porosity Content Variation (PCV) value of all bodies of the plurality of articles is not greater than 1.3.

Embodiment 13. The abrasive article of any one of the preceding Embodiments, wherein the abrasive particles include diamond, cubic boron nitride, or a combination thereof.

Embodiment 14. The abrasive article of Embodiment 13, wherein the abrasive particles include diamond.

Embodiment 15. The abrasive article of Embodiment 14, wherein the abrasive particles consist essentially of diamond.

Embodiment 16. The abrasive article of any one of Embodiments 2, 4, or 5, wherein the body comprises a porosity of at least 40 vol % and not greater than 70 vol % for a total volume of the body.

Embodiment 17. The abrasive article of any one of Embodiments 1, 3, and 13, wherein the porosity of the body is at least 41 vol % for a total volume of the body, or at least 42 vol %, or at least 43 vol %, or at least 44 vol %, or at least 45 vol %, or at least 46 vol %, or at least 47 vol %, or at least 48 vol %, or at least 49 vol %, or at least 50 vol %.

Embodiment 18. The abrasive article of any one of Embodiments 1, 3, and 16, wherein the porosity of the body is not greater than 65 vol %, or not greater than 60 vol %, or not greater than 58 vol %, or not greater than 56 vol %, or not greater than 55 vol %, or not greater than 54 vol %, or not greater than 53 vol %, or not greater than 52 vol %, or not greater than 51 vol %, or not greater than 50 vol %.

Embodiment 19. The abrasive article of Embodiments 17 or 18, wherein the porosity is a least 45 vol % and not greater than 60 vol %, or at least 50 vol % and not greater than 58 vol %, or at least 53 vol % and not greater than 57 vol %.

Embodiment 20. The abrasive article of any one of Embodiments 2, 4, and 5, wherein the body comprises a plurality of pores having an average pore size (D50) of at least 0.1 microns and not greater than 5 microns.

Embodiment 21. The abrasive article of Embodiments 1, 3, or 20, wherein the pores have an average pore size (D50) of at least 0.3 microns, or at least 0.4 microns, or at least 0.5 microns, or at least 0.8 microns, or at least 1 micron, or at least 1.5 microns, or at least 2 microns.

Embodiment 22. The abrasive article of Embodiments 1, 3, or 20, wherein the pores have an average pore size (D50) of not greater than 4 microns or not greater than 3 microns, or not greater than 2.5 microns, or not greater than 2.0 microns, or not greater than 1.5 microns, or not greater than 1.3 microns, or not greater than 1.0 microns, or not greater than 0.8 microns.

Embodiment 23. The abrasive article of any one of the preceding Embodiments, wherein the plurality of pores has a D99 value of not greater than 20 microns, or not greater than 10 microns, or not greater than 5 microns, or not greater than 1 micron, or not greater than 0.95 microns.

Embodiment 24. The abrasive article of any one of the preceding Embodiments, wherein the plurality of pores has a D10-D50 range value of not greater than 1 micron or not greater than 0.5 microns or not greater than 0.3 microns.

Embodiment 25. The abrasive article of any one of the preceding Embodiments, wherein the plurality of pores has a D50-D90 range value of not greater than 1 micron or not greater than 0.5 microns or not greater than 0.4 microns.

Embodiment 26. The abrasive article of any one of the preceding Embodiments, wherein at least 95% of the plurality of pores have a pore size between 0.1 microns to 1 micron, such as at least 96%, or at least 97%, or at least 98%, or at least 99%, or at least 99.5%, at least 99.9%, or 100%.

Embodiment 27. The abrasive article of any one of the preceding Embodiments, wherein the plurality of pores defines a multi-modal size distribution.

Embodiment 28. The abrasive article of Embodiment 27, wherein the plurality of pores defines a bimodal or a trimodal size distribution.

Embodiment 29. The abrasive article of any one of the preceding Embodiments, wherein a ratio [Pt:Po] of the porosity of the body (Pt) to an open porosity (Po) of the body is not greater than 1.25, such as not greater than 1.11 or not greater than 1.05 or not greater than 1.01.

Embodiment 30. The abrasive article of any one of the preceding Embodiments, wherein an amount of the abrasive particles is at least 15 wt % based on a total weight of the body, or at least 20 wt %, or at least 25 wt %, or at least 30 wt %, or at least 35 wt %, or at least 40 wt %, or at least 45 wt %, or at least 50 wt %, or at least 55 wt %, or at least 60 wt %.

Embodiment 31. The abrasive article of any one of the preceding Embodiments, wherein an amount of the abrasive particles is not greater than 95 wt % based on a total weight of the body, or not greater than 94 wt %, or not greater than 93 wt %, or not greater than 92 wt %, or not greater than 90 wt %, or not greater than 85 wt %, or not greater than 80 wt % or not greater than 70 wt % or not greater than 65 wt % or not greater than 60 wt % or not greater than 55 wt % or not greater than 50 wt % or not greater than 45 wt % or not greater than 40 wt %.

Embodiment 32. The abrasive article of any one of the preceding Embodiments, wherein an amount of the bond material is at least 5 wt % based on a total weight of the body, at least 6 wt %, or at least 7 wt %, or at least 10 wt %, or at least 15 wt %, or at least 20 wt %, or at least 25 wt %, or at least 30 wt %.

Embodiment 33. The abrasive article of any one of the preceding Embodiments, wherein an amount of the bond material is not greater than 93 wt % based on a total weight of the body, or not greater than 92 wt %, or not greater than 91 wt %, or not greater than 90 wt %, or not greater than 85 wt %, or not greater than 80 wt %, or not greater than 70 wt %, or not greater than 60 wt %, or not greater than 50 w %, or not greater than 40 wt % or not greater than 35 wt %, or not greater than 30 wt %, or not greater than 20 wt %, or not greater than 15 wt %, or not greater than 10 wt %, or not greater than 8 wt %, or not greater than 6 wt %.

Embodiment 34. The abrasive article of any one of the preceding Embodiments, wherein the bond material consists essentially of the vitreous material.

Embodiment 35. The abrasive article of any one of the preceding Embodiments, wherein the bond material comprises an amorphous phase and/or a polycrystalline phase.

Embodiment 36. The abrasive article of any one of the preceding Embodiments, wherein a weight percent ratio [Cb:Ca] of the bond material [Cb] to the abrasive particles [Ca] is at least 1:15, or at least 1:12, or at least 1:10, or at least 1:8, or at least 1:5.

Embodiment 37. The abrasive article of any one of the preceding Embodiments, wherein a weight percent ratio [Cb:Ca] of the bond material [Cb] to the abrasive particles [Ca] is not greater than 10:1 or not greater than 1:1, or not greater than 1:5, or not greater than 1:10.

Embodiment 38. The abrasive article of Embodiments 36 or 37, wherein the weight percent ratio [Cb:Ca] of the bond material [Cb] to the abrasive particles [Ca] ranges from 1:15 to 10:1, or from 1:15 to 1:4, or from 1:15 to 1:10.

Embodiment 39. The abrasive article of any one of the preceding Embodiments, wherein the body has a density of at least 1.3 g/cm$^3$, or at least 1.35 g/cm$^3$, or at least 1.40 g/cm$^3$, or at least 1.42 g/cm$^3$, or at least 1.44 g/cm$^3$, or at least 31.46 g/cm$^3$, or at least 1.48 g/cm$^3$.

Embodiment 40. The abrasive article of any one of the preceding Embodiments, wherein the body has a density of not greater than 1.6 g/cm$^3$, or not greater than 1.55 g/cm$^3$, or not greater than 1.50 g/cm$^3$, or not greater than 1.48 g/cm$^3$, or not greater than 1.45 g/cm$^3$.

Embodiment 41. The abrasive article of any one of the preceding Embodiments, wherein the body comprises a normalized defect amount (nDFA) of not greater than 5, or not greater than 3, or not greater than 1, the nDFA being a total amount of particle agglomerates per mm$^2$ having a diameter size of 50 microns or greater.

Embodiment 42. The abrasive article of Embodiment 40, wherein the body is free of defects having a diameter size of 50 microns or greater.

Embodiment 43. The abrasive article of any one of Embodiments 1-40, wherein the body comprises a normalized defect amount (nDFA) of not greater than 5, or not greater than 3, or not greater than 1, the nDFA being a total amount of particle agglomerates per mm$^2$ having a diameter size of 18 microns or greater.

Embodiment 44. The abrasive article of Embodiment 43, wherein the body is free of defects having a diameter size of 18 microns or greater.

Embodiment 45. The abrasive article of any one of the preceding Embodiments, wherein the body is essentially free of ceria.

Embodiment 46. The abrasive article of Embodiment 45, wherein the body is free of ceria.

Embodiment 47. The abrasive article of any one of the preceding Embodiments, wherein a material of the body comprises a Shore D hardness according to ASTM D2240 of at least 70, or at least 73, or at least 75, or at least 77.

Embodiment 48. The abrasive article of any one of the preceding Embodiments, wherein a material of the body comprises an elastic modulus (EMOD) according to ASTM E1876 of at least 10 GPa, or at least 11 GPa, or at least 12 GPa, or at least 13 GPa, or at least 14 GPa.

Embodiment 49. The abrasive article of any one of the preceding Embodiments, wherein the abrasive article is configured to conduct a material removal operation on a wafer comprising silicon or a ceramic material selected from the group consisting of oxides, carbides, nitrides, borides, or any combination thereof.

Embodiment 50. The abrasive article of Embodiment 49, wherein the abrasive article is configured to conduct the material a removal operation on a silicon carbide wafer.

Embodiment 51. The abrasive article of Embodiment 50, the abrasive article being adapted for conducting the material removal operation on a silicon carbide wafer to a surface roughness Ra of not greater than 30 Å, or not greater than 25 Å, or not greater than 20 Å, or not greater than 15 Å, or not greater than 10 Å.

Embodiment 52. The abrasive article of Embodiments 50 or 51, the abrasive article being adapted to remove material from a silicon carbide wafer having a diameter of at least 200 mm with a total thickness variation of not greater than 2 microns.

Embodiment 53. The abrasive article of any one of Embodiments 4 and 6-52, wherein the plurality of bodies is attached to the substrate by an adhesive.

Embodiment 54. The abrasive article of any one of Embodiments 4 and 6-53, wherein a material of the substrate includes aluminum or steel.

Embodiment 55. The abrasive article of any one of Embodiments 4 and 6-54, wherein the plurality of bodies comprises at least 45 bodies attached to the substrate, and the substrate has a diameter of not greater than 11 inches.

Embodiment 56. The abrasive article of any one of the preceding Embodiments, wherein an average particle size (D50) of the abrasive particles is at least 0.1 microns, or at least 0.3 microns, or at least 0.4 microns, or at least 0.5 microns, or at least 0.8 microns, or at least 1 micron, or at least 1.5 microns, or at least 2 microns, or at least 3 microns.

Embodiment 57. The abrasive article of any one of the preceding Embodiments, wherein an average particle size (D50) of the abrasive particles is not greater than 5 microns or not greater than 4 microns or not greater than 3 microns or not greater than 2.5 microns, or not greater than 2.0 microns, or not greater than 1.5 microns, or not greater than 1.3 microns, or not greater than 1.0 micron, or not greater than 0.9 microns, or not greater than 0.8 microns, or not greater than 0.7 microns, or not greater than 0.6 microns.

Embodiment 58. A method of forming an abrasive article, comprising:

forming a body, wherein forming the body comprises:

providing a powder mixture including abrasive particles and a bond material, the bond material including a vitreous material;

filling the powder mixture into a mold;

conducting cold-pressing to form a cold-pressed body having a pre-determined volume; and heating the cold-pressed body to a maximum heating temperature of at least 600° C. to form the body, wherein the abrasive particles comprise a superabrasive material and have a particle size of at least 0.05 microns and not greater than 5 microns.

Embodiment 59. The method of Embodiment 58, wherein the powder mixture comprises a water content not greater than 3 wt % based on the total weight of the powder mixture.

Embodiment 60. The method of Embodiments 58 or 59, wherein cold-pressing is conducted at a temperature of at least 20° C., or at least 25° C., or at least 30° C., or at least 40° C.

Embodiment 61. The method of any one of Embodiments 58-60, wherein cold-pressing is conducted at a temperature not greater than 80° C., or not greater than 60° C., or not greater than 50° C., or not greater than 40° C.

Embodiment 62. The method of any one of Embodiments 58-61, wherein cold pressing is conducted at a pressure of at least 40 MPa, or at least 100 MPa, or at least 120 MPa.

Embodiment 63. The method of any one of Embodiments 58-62, wherein cold pressing is conducted at a pressure not greater than 150 MPa, or not greater than 130, or not greater than 125 MPa.

Embodiment 64. The method of any one of Embodiments 58-63, wherein filling of the mold comprises adding the powder mixture into the mold in at least two steps and pre-compacting the powder mixture to remove entrapped air.

Embodiment 65. The method of Embodiment 64, wherein filling of the mold with the powder mixture comprises at least three steps.

Embodiment 66. The method of Embodiments 64 or 65, wherein filling of the mold with the powder mixture comprises pre-compacting the powder mixture to a tap density of the powder mixture.

Embodiment 67. The method of Embodiment 66, wherein the tap density of the powder within the mold is at least 0.45 g/cm$^3$, or at least 0.50 g/cm$^3$, or at least 0.52 g/cm$^3$, or at least 0.54 g/cm$^3$.

Embodiment 68. The method of any one of Embodiments 58-67, wherein the pre-determined volume of the cold-pressed body corresponds to a density after heating of at least 1.3 g/cm$^3$, or at least 1.35 g/cm$^3$, or at least 1.40 g/cm$^3$, or at least 1.42 g/cm$^3$, or at least 1.44 g/cm$^3$, or at least 1.46 g/cm$^3$.

Embodiment 69. The method of any one of Embodiments 58-68 wherein the pre-determined volume of the cold-pressed body corresponds to a density after heating of not greater than 1.6 g/cm$^3$, or not greater than 1.55 g/cm$^3$, or not greater than 1.50 g/cm$^3$, or not greater than 1.45 g/cm$^3$.

Embodiment 70. The method of any one of Embodiments 58-69, wherein the maximum heating temperature is at least 620° C., or at least 650° C., or at least 680° C., or at least 700° C.

Embodiment 71. The method of any one of Embodiments 58-70, wherein the maximum heating temperature is not greater than 850° C., or not greater than 800° C., or not greater than 750° C.

Embodiment 72. The method of any one of Embodiments 58-71, wherein the abrasive particles consist essentially of diamond particles.

Embodiment 73. The method of any one of Embodiments 58-72, wherein an average particle size (D50) of the powder mixture is at least 0.5 microns, or at least 0.6 microns, or at least 0.8 microns or at least 1 micron.

Embodiment 74. The method of any one of Embodiments 58-73, wherein an average particle size (D50) of the powder mixture is not greater than 2 microns, or not greater than 1.5 microns, or not greater than 1.0 microns.

Embodiment 75. The method of any one of Embodiments 58-74, wherein a D90 value of the powder mixture is not greater than 7 microns, or not greater than 5 microns, or not greater than 4 microns.

Embodiment 76. The method of any one of Embodiments 58-75, wherein a D99 value of the powder mixture is not greater than 15 microns, or not greater than 10 microns, or not greater than 9 microns.

Embodiment 77. The method of any one of Embodiments 58-76, wherein the powder mixture further comprises an organic binder.

Embodiment 78. The method of Embodiment 77, wherein the organic binder includes a polyether, a phenolic resin, an epoxy resin, a polyester resin, a polyurethane, a polyester, a polyimide, a polybenzimidazole, an aromatic polyamide or any combination thereof.

Embodiment 79. The method of Embodiment 78, wherein the organic binder includes a polyether.

Embodiment 80. The method of Embodiment 79, wherein the polyether includes polyethylene glycol (PEG).

Embodiment 81. The method of any one of Embodiments 78-80, wherein an amount of the organic binder is at least 0.8 wt % based on the total weight of the powder mixture, or at least 1 wt %, or at least 1.5 wt %, or at least 2.0 wt %, or at least 3 wt %.

Embodiment 82. The method of any one of Embodiments 77-81, wherein an amount of the organic binder is not greater than 10 wt % based on the total weight of the powder mixture, or not greater than 5 wt %, or not greater than 3 wt %.

Embodiment 83. The method of Embodiment 80, wherein a molecular weight of the PEG is not greater than 18,000, or not greater than 15,000, or not greater than 10,000, or not greater than 9000, or not greater than 8,000, or not greater 7,000.

Embodiment 84. The method of Embodiment 80, wherein a molecular weight of the PEG is at least 1000, or at least 3000, or at least 5000, or at least 7000, or at least 8000.

Embodiment 85. The method of any one of Embodiments 58-84, wherein the powder mixture is essentially free of ceria.

Embodiment 86. The method of Embodiment 85, wherein the powder mixture is free of ceria.

Embodiment 87. The method of any one of Embodiments 58-86, wherein after heating the body consists essentially of diamond particles and vitreous bond material.

Embodiment 88. The method of any one of Embodiments 58-87, further comprising cutting the body after heating into a plurality of bodies.

Embodiment 89. The method of Embodiment 88, further comprising attaching the plurality of bodies to a substrate with an adhesive.

Embodiment 90. The method of Embodiments 88 or 89, wherein a Porosity Content Variation (PCV) value of the plurality of bodies is not greater than 1.3.

EXAMPLES

Example 1

Figure 3:
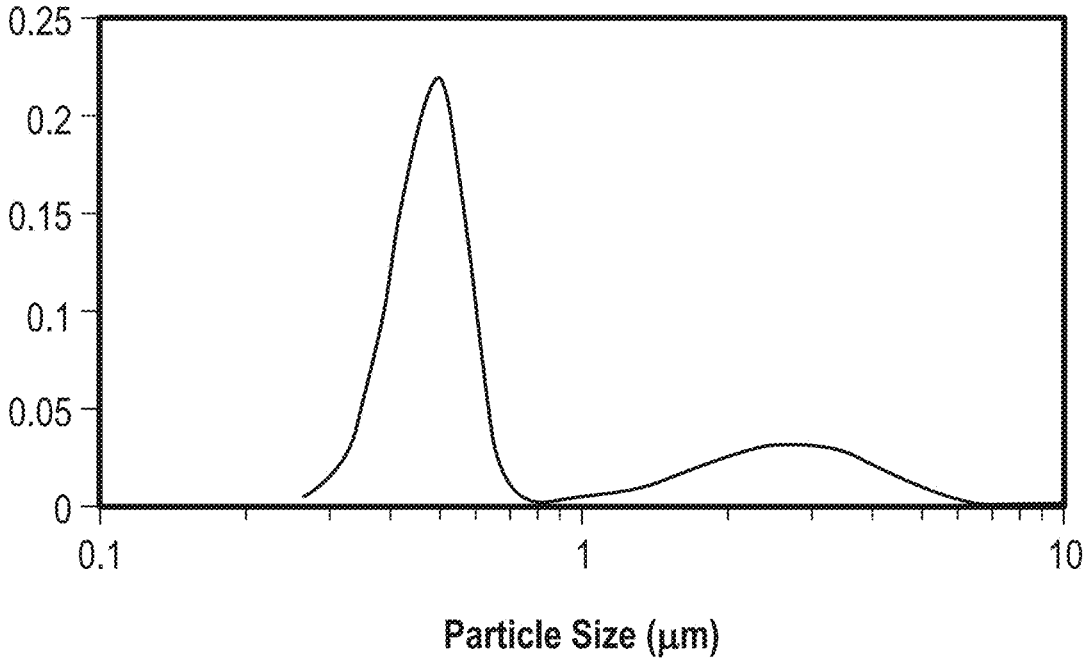
FIG. 3 includes a graph illustrating the particle size distribution of the powder mixture according to one embodiment.

A raw material powder having a particle size distribution as illustrated in FIG. 3 was used to create 10 body samples. The raw material powder was a homogeneous fine powder mixture made from approximately 91.5 wt % diamond particles having an average particles size (D50) of about 0.5 microns, 7.0 wt % of a vitreous material having an average particle size of 2.5 microns, and 1.5 wt % of an organic binder (polyethylene glycol).

A mold was filled with the 47.5 g of the raw material powder by adding the powder to the mold in three steps combined with agitating the powder to obtain a desired tap density of about 0.543 g/cm$^3$.

After filling the mold, the mold was closed and the powder was cold pressed at room temperature to a pre-calculated volume of 33 cm$^3$. The applied pressure was about 9 tons/inch$^2$ (124 MPa) for about 10 seconds. After the cold-pressing, the pressed body was removed from the mold and transferred to an oven. Heating of the pressed body was conducted at a heat rate of 1° C./min up to 515° C., followed by a rate of 2° C./min up to a temperature of 700° C., and maintained at 700° C. for three hours.

A series of ten sintered bodies (samples 1 to 10) was made according to the above described process. The making of the body of sample S1 was well repeatable, such that the standard deviation of the porosity values between the ten samples was 0.122, which is herein also called the Porosity Content Variation (PCV) value. The measured density (weight divided by volume) of each body after heating and cooling to room temperature was 1.44 g/cm$^3$.

TABLE 1

| Sample | Density after Cold Pressing and Heating [g/cc] | Porosity [vol %] | Pore Distribution |
|---|---|---|---|
| S1 | 1.44 | 55.1 | 99% of pore volume < 1 μm |
| S2 | 1.44 | 55.16 | 99% of pore volume < 1 μm |
| S3 | 1.44 | 55.12 | 99% of pore volume < 1 μm |
| S4 | 1.44 | 55.27 | 99% of pore volume < 1 μm |
| S5 | 1.44 | 55.05 | 99% of pore volume < 1 μm |
| S6 | 1.44 | 55.13 | 99% of pore volume < 1 μm |
| S7 | 1.44 | 55.15 | 99% of pore volume < 1 μm |
| S8 | 1.44 | 55.18 | 99% of pore volume < 1 μm |
| S9 | 1.44 | 54.91 | 99% of pore volume < 1 μm |
| S10 | 1.44 | 54.87 | 99% of pore volume < 1 μm |

All pore size distributions described herein were measured with a Micromeritics AutoPore IV mercury porosimeter according to ASTM D4404-10. The porosity was measured according to the Archimedes method, via water saturation of the pores.

The porosity measurement was conducted by placing the sample body for about 2 hours in an oven at 80° C. and immediately measuring the dry weight of the body ($W_{bd}$) after removing it from the oven. After measuring the dry weight, the body was placed in a chamber including distilled water and immersed within the water, and the weight gain ($W_{ba}$) of the body by absorbing the water was followed with a scale. Once a stable weight of the body within the water was obtained, the body was removed from the water and dried with a damp cloth to remove excess water and the body was immediately weight again to obtain the weight of the body saturated with the water ($W_{bs}$). The porosity was calculated by the following equation: $P\ (\%) = (V_{body\ w} - V_{body\ true}/V_{body\ w}) \times 100$, wherein $V_{body\ w} = W_{bs} - W_{bd}/d_w$ and $V_{true} = W_{bd}/d_{theo}$, $d_{theo}$ being the theoretical density of the body without pores. As theoretical density for the bodies of Example 1 was calculated a value of 3.21 g/cm$^3$, based on the amount of diamond and vitreous bond material and excluding the pore volume. The densities of the bodies were calculated also based on the values obtained during conducting the Archimedes method, by dividing the dry weight of the body ($W_{bd}$) by the volume of the body ($V_{body\ w}$).

The porosity values measured via the Archimedes method and recited in Table 1 and 2 relate to the open porosity of the measured samples, that means the pores accessible to the water. The percentage of the closed porosity (not reached by the water) was for all samples below 1 vol % based on the total volume of the body. The closed porosity was calculated based on the theoretical density (calculated density for zero porosity), the actual density, and the measured "open" porosity via the above-described Archimedes method.

Another series of 9 body samples (samples S11-S19) was prepared the same way as the samples of Table 1, except that the powder material was added to the mold in one step and without agitating the powder to its tap density. A summary of the obtained porosities and densities is shown in Table 2.

It can be seen in Table 2 that the obtained porosities had a much greater porosity variation (between about 49% and 54%), with a standard deviation of 1.47 (corresponding to a PCV value of 1.47). It could be further observed by measuring the pore size distribution of the bodies that more than 3% of the pore volume contributed to pores greater than 1 micron. Similarly, the variation of the densities of the bodies after cold-pressing and heating was also large, ranging from 1.48 to 1.62 g/cm$^3$.

TABLE 2

| Sample | Density after cold-pressing and heating [g/cc] | Porosity [vol %] | Pore Size Distribution |
|---|---|---|---|
| S11 | 1.48 | 53.92 | more than 3% of pore volume > 1 micron |
| S12 | 1.49 | 53.49 | more than 3% of pore volume > 1 micron |
| S13 | 1.54 | 51.93 | more than 3% of pore volume > 1 micron |
| S14 | 1.57 | 51.02 | more than 3% of pore volume > 1 micron |
| S15 | 1.57 | 50.99 | more than 3% of pore volume > 1 micron |
| S16 | 1.58 | 50.76 | more than 3% of pore volume > 1 micron |
| S17 | 1.59 | 50.33 | more than 3% of pore volume > 1 micron |
| S18 | 1.60 | 50.29 | more than 3% of pore volume > 1 micron |
| S19 | 1.62 | 49.61 | more than 3% of pore volume > 1 micron |

Example 2

Investigation of Microstructure.

Figure 4A:
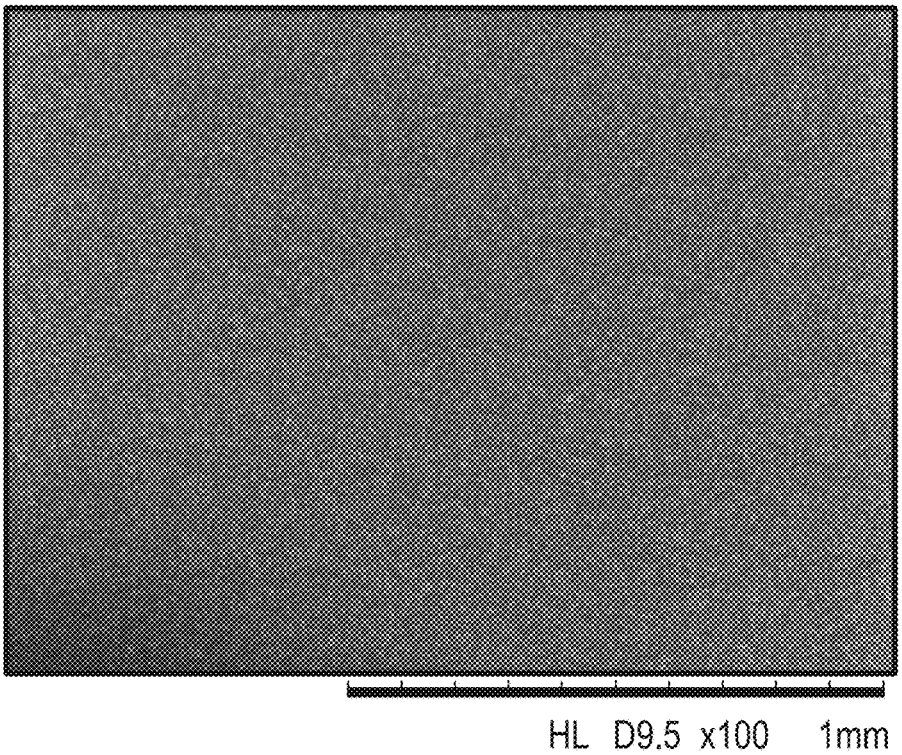
FIG. 4A includes an optical microscope image of a section of a body according to one embodiment.
Figure 4B:
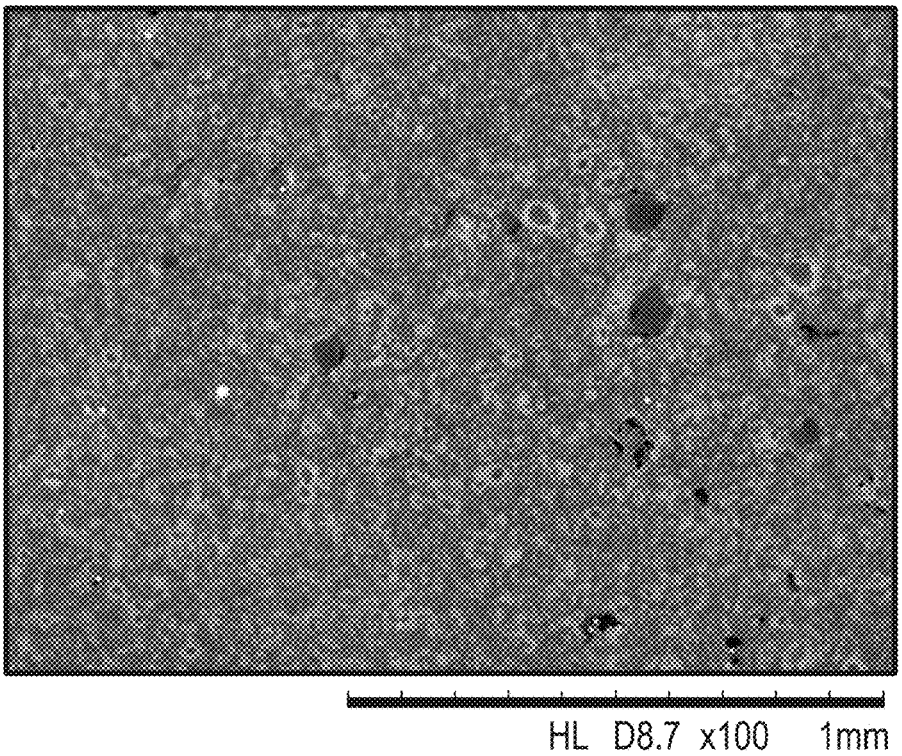
FIG. 4B includes an optical microscope image of a section of a comparative body.

An SEM image of a section of a crosscut of Sample 9 of Example 1 is shown in FIG. 4A to illustrate the microstructure of the body. It can be seen that the body had a very homogenous structure, without any larger agglomerates of particles and without larger pores or cracks. An image analysis made with ImageJ software showed that the crosscut section of the body shown in FIG. 4A contained no agglomerates (herein also called defects) having a diameter size of 50 microns or larger within an area of 1 $mm^2$.

Furthermore, the analysis of the image of FIG. 4A with a focus on detecting defects having a size of 18 microns or greater revealed that the body contained less than 5 defects within an area of 1 $mm^2$, wherein an average of 3 images at different positions were taken for the analysis.

Figure 2A:
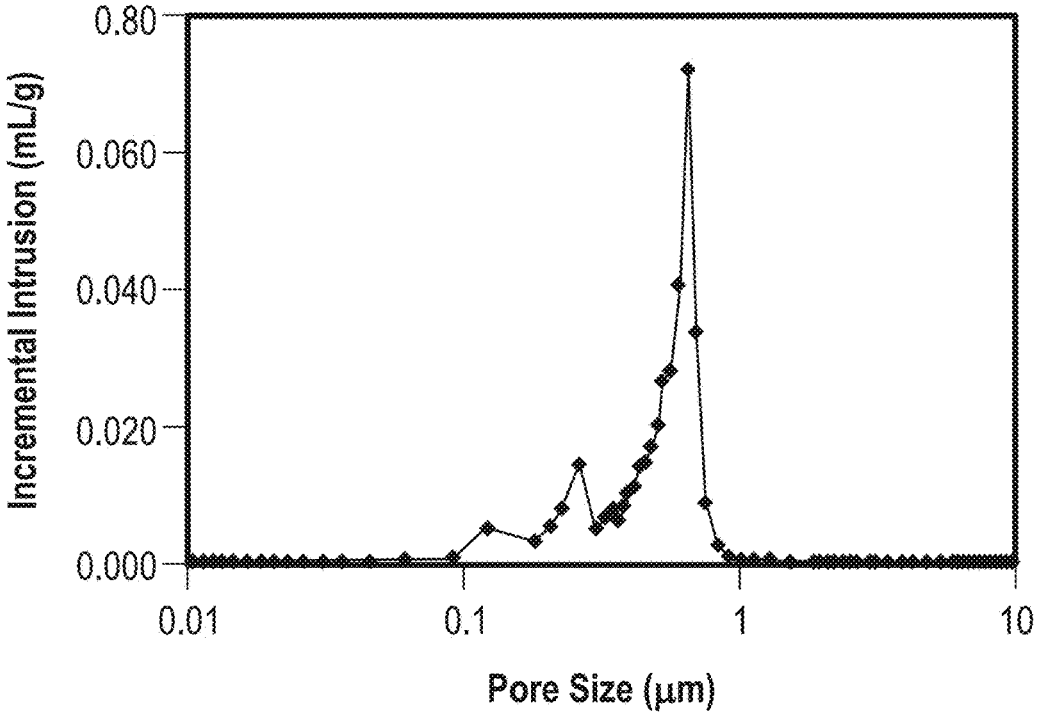
FIG. 2A includes a graph illustrating the pore size distribution of a body according to one embodiment.
Figure 2B:
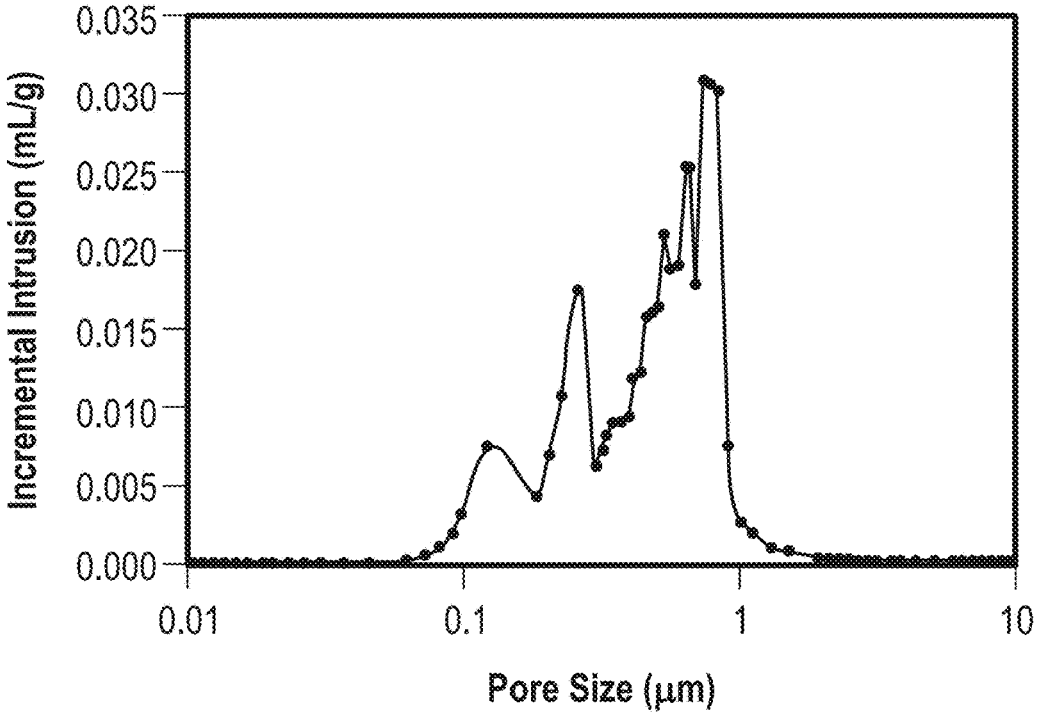
FIG. 2B includes a graph illustrating a pore size distribution of a body according to one embodiment.

In contrast, a comparative body is shown in FIG. 2B, which was made with the same types and amount of starting ingredients (diamond particles, vitreous bond, organic binder) but not prepared according to embodiments of the method disclosed herein. It can be seen that the microstructure is much more uneven. The image analysis of the microstructure of the sample shown in FIG. 2B identified an amount of 200 defects per $mm^2$ with a diameter size of 50 microns or greater.

The body of the sample shown in FIG. 4A was further analyzed by its pore size distribution using a Micromeritics AutoPore IV mercury porosimeter according to ASTM D4404-10.

A graph of the pore size distribution is shown in FIG. 2A, and the D10, D50, D90 and D99 are summarized in Table 3. The measured pore size distribution confirms the homogeneous structure of the body shown in FIG. 4A. It can be seen that the body had a narrow pore size distribution, wherein up to the D99 value all pores were smaller than 1 micron.

TABLE 3

| Pore Size Distribution | Sample 9 |
|---|---|
| D10 [microns] | 0.316 |
| D50 [microns] | 0.571 |
| D90 [microns] | 0.704 |
| D99 [microns] | 0.916 |

Example 3

Mechanical Properties with Varying Porosity.

A variety of bodies having a porosity between 52 and 59 percent were prepared and tested for the mechanical properties Shore D Hardness and elastic modulus (EMOD). The bodies with different porosities were formed by varying the amount of powder mixture filled into the mold, while pressing to the same volume, as described in Example 1.

Figure 7:
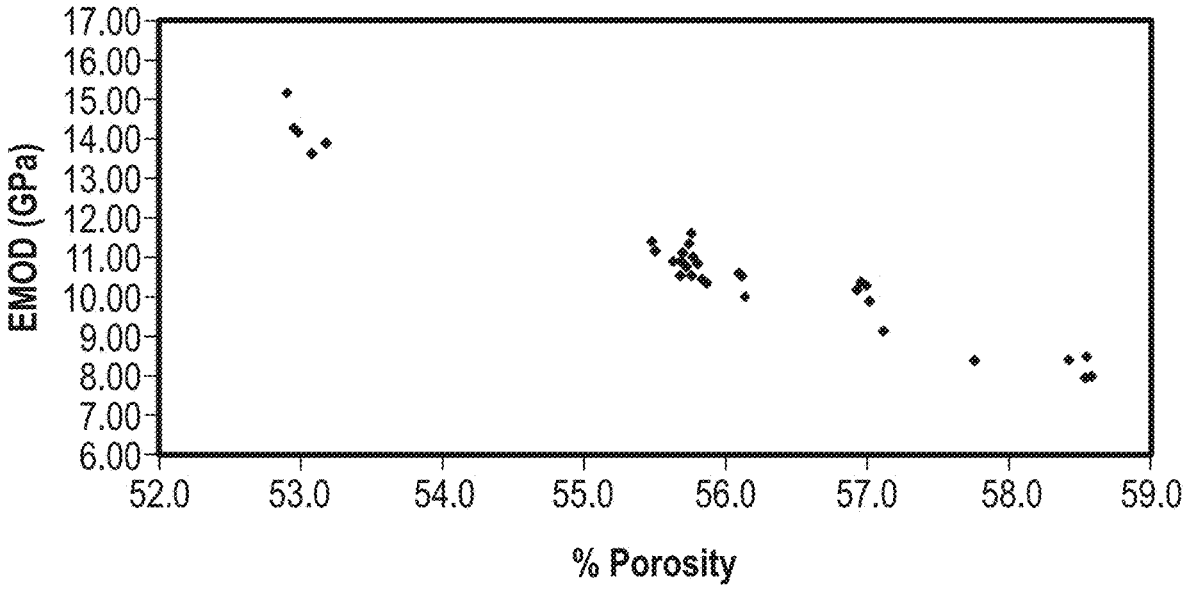
FIG. 7 includes a graph showing a relationship of the elastic modulus vs. porosity according to embodiments.
Figure 8:
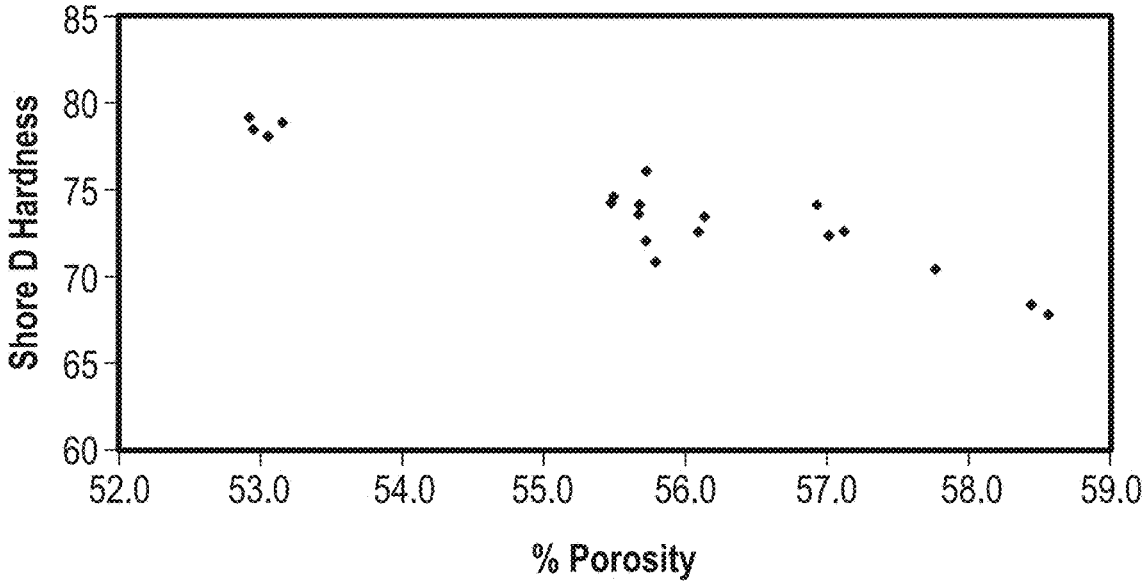
FIG. 8 includes a graph showing a relationship of the Shore D hardness vs. porosity according to embodiments.

A summary of the Shore D Hardness measurements of the body samples is shown in FIG. 7. It can be seen that the highest Shore D hardness was obtained with bodies having a porosity of around 53%. The Shore D hardness was measured according to ASTM-D2240.

A similar trend could be observed with regard to the elastic modulus (EMOD). The best values also were observed at around 53% porosity, while with further increasing porosity, the EMOD declined. The EMOD was determined according to ASTM-E1876.

Example 4

Assembling of an Abrasive Wheel.

Figure 5:
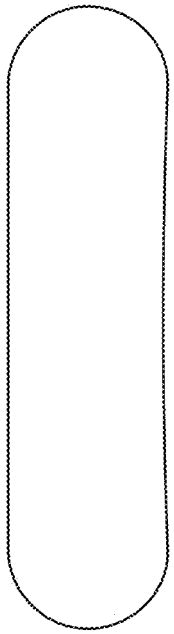
FIG. 5 includes an illustration of a shape of a body of the abrasive article according to one embodiment.

Sintered bodies made according to the description of Example 1, samples S1-S10, were cut into smaller body segments, herein also called a plurality of bodies, wherein each body segment had the shape of about 0.5 inches length, 0.125 inches height, and 0.25 inches thickness, with rounded edges, as illustrated in FIG. 5.

Figure 6:
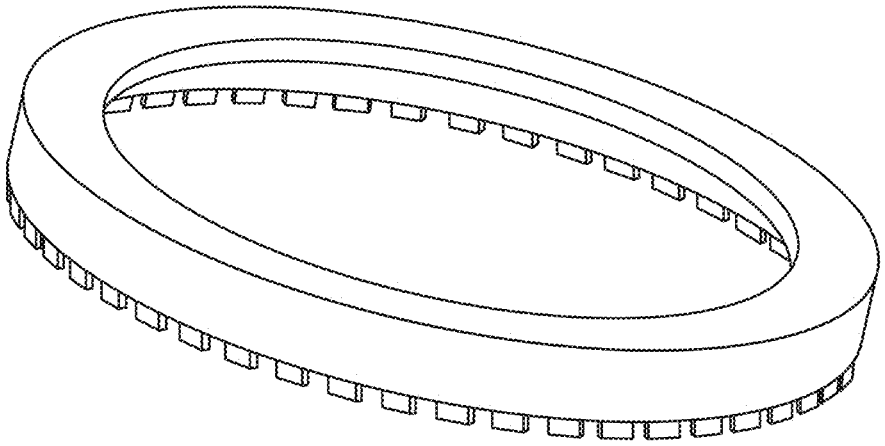
FIG. 6 includes an illustration of an abrasive article comprising a plurality of bodies according to one embodiment.

The body segments were attached to the outer surface of a preformed wheel substrate using an epoxy adhesive. An illustration of a wheel containing 48 attached body segments (a plurality of 48 bodies) covering a round substrate area of a diameter of 11 inches is shown in FIG. 6.

It will be appreciated that the body segment described and shown in this Example is only one non-limiting embodiment, and the shape of the body segment and arrangement of the plurality of bodies on a substrate can have a large variety. Furthermore, the abrasive wheel can have a diameter size larger or smaller than 11 inches.

Example 5

Testing of Grinding Performance.

The grinding performance of a representative body having a porosity of 52.8% (sample S20) was compared with the grinding performance of a body which was made by over pressing (C1). Over pressing was conducted by increasing the amount of powder in the mold and pressing to the same volume. A further comparative body (C2) was tested which had a porosity similar to sample S20 but had a less homogeneous structure with a defect amount of about 22 defects per $mm^2$.

TABLE 4

| Sample | Porosity [vol %] | Amount of ≥50 μm Defects per mm$^2$ | Max. Force [lbs] | Ra [Å] | Valley depth [Å] |
|---|---|---|---|---|---|
| S20 | 52.8 | 0 | 56 | 17.5 | 118 |
| C2 | 46.6 | 0 | >100 | | |
| C3 | 50.0 | 22 | 26 | 21.0 | 1192 |

Abrasive wheels were prepared having the structure of the multi-segment wheel as shown in FIG. 6, using as segments the body samples summarized in Table 4. The grinding experiments were conducted with a Revasum 7AF-HMG grinder and used as substrates silicon carbide wafers of 4H—N type having a diameter of 6 inches.

It can be seen from the results summarized in Table 4 that wheels made from the over-pressed body required a too high maximum force (>100 lbs) for the grinding. Although comparative wheel C3 required a low maximum force of 23 lbs, the valley depth (sub-surface induced damage of the wafer) was very high (1192 microns). Wheels of body sample S21 achieved an excellent surface finish with a low surface roughness and an about ten times lower valley depth as sample C3.

The foregoing embodiments are directed to bonded abrasive products, particularly for precision grinding, which represents a departure from the state-of-the-art.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Reference herein to a material including one or more components may be interpreted to include at least one embodiment wherein the material consists essentially of the one or more components identified. The term "consisting essentially" will be interpreted to include a composition including those materials identified and excluding all other materials except in minority contents (e.g., impurity contents), which do not significantly alter the properties of the material. Additionally, or in the alternative, in certain non-limiting embodiments, any of the compositions identified herein may be essentially free of materials that are not expressly disclosed. The embodiments herein include a range of contents for certain components within a material, and it will be appreciated that the contents of the components within a given material total 100%.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An abrasive article comprising:

a substrate;

a plurality of bodies attached to the substrate, the plurality of bodies comprises a plurality of pores having a D90 of not greater than 10 microns, and wherein the plurality of bodies comprises a normalized Porosity Content Variation (PCV) value of not greater than 1.3; and wherein each body of the plurality of bodies comprises abrasive particles contained in a bond material including a vitreous material.

2. The abrasive article of claim 1, wherein each body of the plurality of bodies comprises:

a) a porosity of at least 40 vol % and not greater than 70 vol % for a total volume of the body;

b) a content of abrasive particles of at least 10 wt % and not greater than 94 wt % for a total weight of the body;

c) an average particle size (D50) of the abrasive particles of at least 0.05 microns and not greater than 5 microns; and d) an average pore size (D50) of the plurality of pores being at least 0.1 microns and not greater than 5 microns.

3. The abrasive article of claim 1, wherein each body of the plurality of bodies comprises a porosity of at least 50 vol % and not greater than 70 vol % for a total volume of the body.

4. The abrasive article of claim 1, wherein the amount of bond material in each body of the plurality of bodies is at least 5 wt % and not greater than 15 wt % based on the total weight of the body.

5. The abrasive article of claim 1, wherein the amount of abrasive particles in each body of the plurality of bodies is at least 60 wt % and not greater than 93 wt % based on the total weight of the body.

6. The abrasive article of claim 1, wherein each body of the plurality of bodies comprises a weight percent ratio [$C_b$:$C_a$] of the bond material [$C_b$] to the abrasive particles [$C_a$] in a range from 1:15 to 10:1.

7. The abrasive article of claim 1, wherein an average particle size (D50) of the abrasive particles is at least 0.05 microns and not greater than 2 microns.

8. The abrasive article of claim 1, wherein an average pore size (D50) of the plurality of pores is at least 0.1 microns and not greater than 2 microns.

9. The abrasive article of claim 1, wherein the abrasive particles include diamond, cubic boron nitride, or a combination thereof.

10. The abrasive article of claim 9, wherein the abrasive particles consist essentially of diamond.

11. The abrasive article of claim 1, wherein the bond material consists essentially of a vitreous material.

12. The abrasive article of claim 1, wherein the abrasive article is configured to conduct a material removal operation on a silicon carbide wafer or a silicon carbide ingot.

13. The abrasive article of claim 1, wherein the plurality of pores define a pore size distribution having a 10th percentile value (D10), and further wherein the distance between the 10th percentile (D10) and an average pore size (D50) is not greater than 1 micron, and further wherein the distance between the average pore size (D50) and the 90$^{th}$ percentile value (D90) can be not greater than 1 micron, and wherein the plurality of pores has a D90 value of at least 0.5 microns and not greater than 5 microns, and further wherein the plurality of pores has a D10 value of at least 0.05 microns and not greater than 0.7 micron.

14. The abrasive article of claim 1, wherein the body comprises an elastic modulus (EMOD) according to ASTM E1876 of at least 10 GPa.

15. The abrasive article of claim 1, wherein the amount of the plurality of bodies attached to the substrate is at least 15 bodies and not greater than 500 bodies.

16. The abrasive article of claim 1, wherein the plurality of bodies comprises a combined volume of at least 0.20 $cm^3$ and not greater than 20 $cm^3$.

17. The abrasive article of claim 1, wherein each body of the plurality of bodies comprises a normalized defect amount (nDFA) of not greater than 5, the nDFA being defined as a total amount of particle agglomerates per $mm^2$ having a diameter size of 18 microns or greater.

18. The abrasive article of claim 1, wherein e normalized Porosity Content Variation (PCV) value of the plurality of bodies is at least not greater than 1.0.

19. The abrasive article of claim 18, wherein the normalized Porosity Content Variation (PCV) value of the plurality of bodies is not greater than 0.6.

20. The abrasive article of claim 5, wherein the amount of the abrasive particles is at least 80 wt % and not greater than 93 wt %.

21. The abrasive article of claim 1, further comprising a plurality of bodies attached to a substrate, wherein the abrasive article is configured to be moved relative to a surface of the silicon carbide wafer to reduce the surface roughness (Ra) of the silicon carbide wafer to not greater than 50 Å, wherein the silicon carbide wafer has a diameter of at least 200 mm and a total thickness variation of not greater than 2 microns.

22. An abrasive article comprising:

a substrate;

a plurality of bodies attached to the substrate, the plurality of bodies comprises a plurality of pores defining a pore size distribution having a 10th percentile value (D10), and wherein the distance between the 10th percentile (D10) and an average pore size (D50) is not greater than 1 micron, and wherein the plurality of bodies comprises a normalized Porosity Content Variation (PCV) value of not greater than 1.3; and wherein each body of the plurality of bodies comprises abrasive particles contained in a bond material including a vitreous material.

23. The abrasive article of claim 22, wherein each body of the plurality of bodies comprises a) a porosity of at least 40 vol % and not greater than 70 vol % for a total volume of the body;

b) a content of abrasive particles of at least 10 wt % and not greater than 94 wt % for a total weight of the body;

c) an average particle size (D50) of the abrasive particles of at least 0.05 microns and not greater than 5 microns; and d) an average pore size (D50) of the plurality of pores being at least 0.1 microns and not greater than 5 microns.

24. The abrasive article of claim 22, wherein the normalized Porosity Content Variation (PCV) value of the plurality of bodies is at least not greater than 1.0.

25. The abrasive article of claim 24, wherein the normalized Porosity Content Variation (PCV) value of the plurality of bodies is not greater than 0.6.

26. The abrasive article of claim 22, wherein the plurality of pores has a D10 value of at least 0.05 microns and not greater than 0.7 micron and wherein the average pore size (D50) of the plurality of pores is at least 0.1 microns and not greater than 1.5 microns.

27. The abrasive article of claim 22, wherein the distance between the 10th percentile (D10) and the average pore size (D50) is not greater than 0.8 microns.

28. The abrasive article of claim 22, further comprising a plurality of bodies attached to a substrate, wherein the abrasive article is configured to be moved relative to a surface of the silicon carbide wafer to reduce the surface roughness (Ra) of the silicon carbide wafer to not greater than 50 Å, wherein the silicon carbide wafer has a diameter of at least 200 mm and a total thickness variation of not greater than 2 microns.

29. The abrasive article of claim 22, wherein the abrasive particles include diamond, cubic boron nitride, or a combination thereof.

30. The abrasive article of claim 22, wherein the abrasive article is configured to conduct a material removal operation on a silicon carbide wafer or a silicon carbide ingot.

31. The abrasive article of claim 30, wherein the body comprises an elastic modulus (EMOD) according to ASTM E1876 of at least 10 GPa.

* * * * *